United States Patent [19]

Kramer et al.

[11] Patent Number: 4,483,395

[45] Date of Patent: Nov. 20, 1984

[54] WIRE GUARD DEVICE FOR WELLS

[75] Inventors: Dean C. Kramer, Mason City; Jay D. Crawford, Sheffield, both of Iowa

[73] Assignee: Martinson Manufacturing Company, Inc., Sheffield, Iowa

[21] Appl. No.: 519,191

[22] Filed: Aug. 1, 1983

[51] Int. Cl.[3] ..... E21B 17/10

[52] U.S. Cl. ..... 166/241; 174/47

[58] Field of Search ..... 166/241, 65; 174/99 R, 174/99 B, 47, 155; 138/108, 113, 114; 285/DIG. 22, 373, 419, 423; 24/270, 271; 248/113

[56] References Cited

U.S. PATENT DOCUMENTS

| | | | |
|---|---|---|---|
| 2,709,094 | 5/1955 | Polanski | 24/270 |
| 3,272,913 | 9/1966 | Crimmins et al. | 174/155 |
| 3,933,203 | 1/1976 | Evans | 166/241 |
| 3,992,565 | 11/1976 | Gatfield | 174/47 X |
| 3,996,414 | 12/1976 | Artbauer et al. | 174/111 X |
| 4,042,023 | 8/1977 | Fox | 166/241 |
| 4,405,161 | 9/1983 | Young et al. | 285/373 X |

*Primary Examiner*—James A. Leppink
*Assistant Examiner*—Thuy M. Bui
*Attorney, Agent, or Firm*—Williamson, Bains, Moore & Hansen

[57] ABSTRACT

A one-piece wire guard device formed of non-metallic material for use in wells includes an inner ring having a split therein defining an opening and having a portion of reduced thickness defining a hinge. Arcuate sections are disposed concentrically outwardly of the inner ring and are connected to the latter by ribs. The ribs, arcuate sections and inner ring cooperate with each other to define openings for accommodating electric wires, ropes and the like therethrough. A guard device may be flexed about its hinge from a normally closed condition to an open position to permit a drop pipe to be inserted through the opening defined by the split. Releasably locking means lock the guard device upon the drop pipe. Spacer tabs extend outwardly from the arcuate sections and engage a well casing to space the drop pipe from the casing and thereby prevent damage to the drop pipe, electrical wires, safety ropes and the like extending through the guard device.

7 Claims, 4 Drawing Figures

WIRE GUARD DEVICE FOR WELLS

SUMMARY OF THE INVENTION

This invention relates to wire guard devices, and more particularly to wire guard devices which are used in well casings.

In many conventional wells, the drop pipe is positioned in a well casing, and the lower end of the drop pipe has a pump attached thereto. Electrical conductors, cables, safety ropes and the like, which are attached to the pump, extend alongside the drop pipe in the well casing. The drop pipe, wires, cables and safety rope are subject to abrasion against the inner surface of the well casing.

Wire guard devices have been developed which are attached to the drop pipe and space the latter in substantially centered relation in the casing. These guard devices also have apertures therein for accommodating cables, wires, safety ropes and the like to prevent damage thereto. Typical of these devices is the one shown in U.S. Pat. No. 3,933,203. While this device prevents damage to the drop pipe and the control lines, one of the problems associated with this kind of guard device is the requirement that the guard device be strung over the end of the drop pipe section. In this regard, the device disclosed in U.S. Pat. No. 3,933,203 is a split-ring guard device, but cannot be opened wide enough to slip the guard device on the drop pipe. It is therefore necessary to string the drop pipe through the central opening in this type of device, and this involves a time-consuming operation.

It is therefore a general object of this invention to provide a guard device which protects the drop pipe, wires, cables and the like from abrasion, yet may be readily applied to the drop pipe.

More specifically, it is an object of this invention to provide a split-ring type guard device which may be readily opened at the split to permit the guard device to be slipped over the drop pipe and fastened thereon.

These and other objects and advantages of the invention will appear more fully from the following description made in conjunction with the accompanying drawings wherein like reference characters refer to the same or similar parts throughout the several views.

FIGURES OF THE DRAWING

DESCRIPTION OF THE PREFERRED EMBODIMENT

Figure 1:
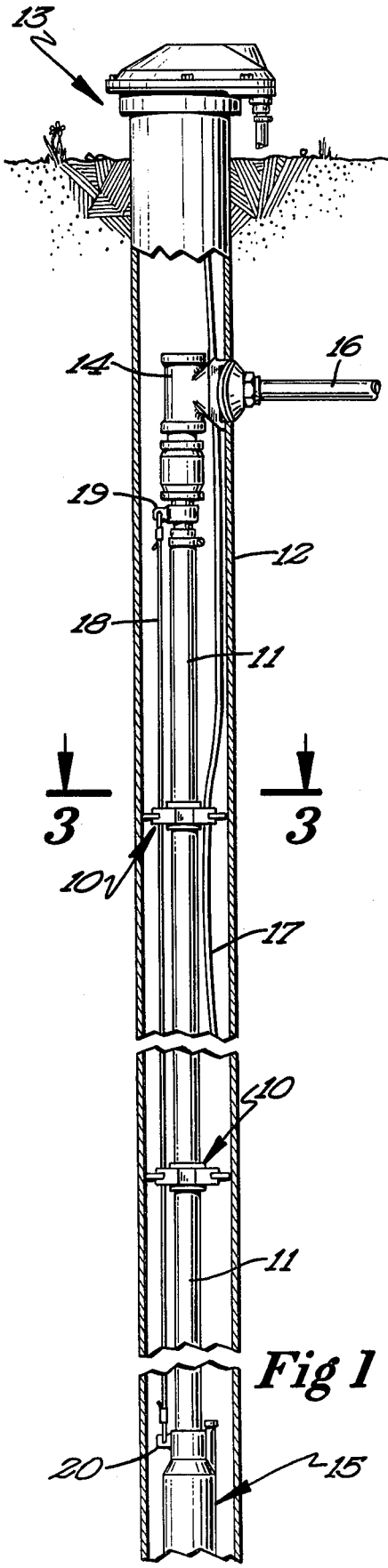
FIG. 1 is a side elevational view of a conventional well employing the improved wire guard device and with the well casing broken away in part to illustrate the relationship of the various parts.

Referring now to the drawings, and more specifically to FIG. 1, it will be seen that one embodiment of the novel wire guard device, designated generally by the reference numeral 10, is illustrated attached to a drop pipe 11 positioned in a conventional well casing 12 of a well 13. The drop pipe 11 is connected at its upper end to a pitless well adapter 14 and is connected in communicating relation at its lower end to a pump 15. The outlet side of the pitless well adapter 14 is connected to a horizontal line 16 through which water pumped through the drop pipe 11 by the pump 15 is directed.

An electrical conductor 17 is connected to the pump 15 and extends upwardly therefrom through the casing and exteriorly of the well at the top thereof for connection to a source of electrical current. On some occasions, the drop pipe 11 may break or otherwise fail, and it is desirable to provide means of restraining the pump from falling downwardly into the casing, since retrieval may be difficult if not impossible. Therefore, a safety rope 18 is connected at its upper end to a bracket 19 which is mounted on pitless well adapter 14. The lower end portion of the safety rope 18 is connected to a bracket 20 mounted on the pump 15.

Figure 2:
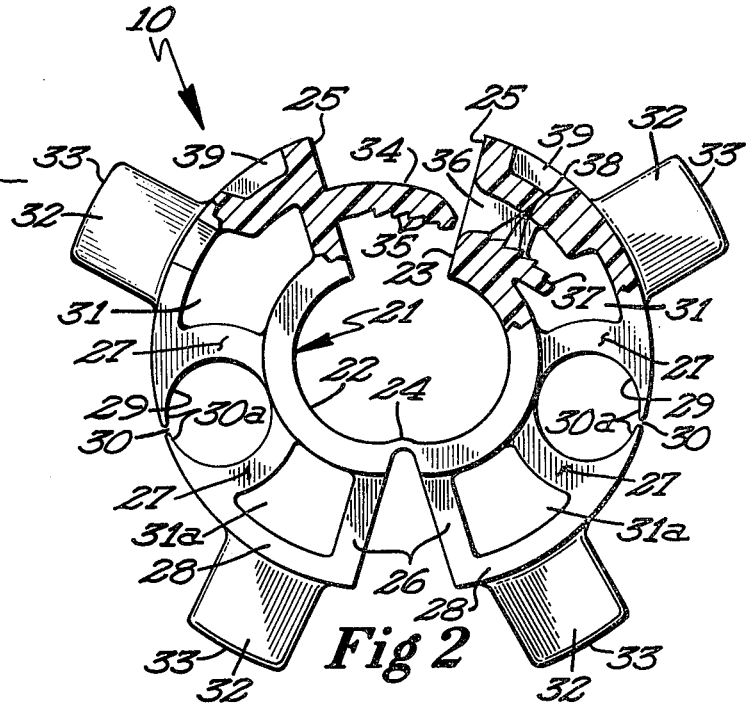
FIG. 2 is a top plan view of the novel wire guard device with certain parts thereof broken away for clarity.
Figure 3:
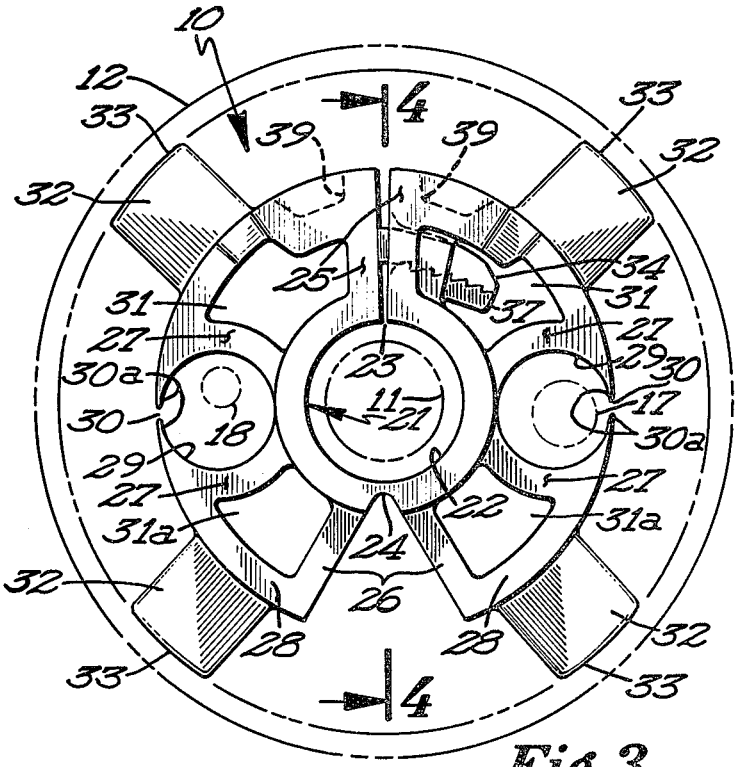
FIG. 3 is a cross-sectional view taken approximately along line 3—3 of FIG. 1 and looking in the direction of the arrows.

The drop pipe 11 is comprised of a plurality of pipe sections secured together in sealing relation, and a plurality of the novel wire guard devices are applied to the drop pipe at spaced points therealong. Each wire guard device 10 is molded of a suitable non-metallic, preferably inert, material, such as low density polyethylene or the like. Each guard device includes a generally cylindrical inner ring 21 having a substantially cylindrical inner surface 22 which is adapted to engage the exterior surface of the drop pipe 11. The inner ring 21 has a split or cut 23 therein which extends throughout the vertical dimension of the ring. The thickness dimension of the inner ring 21 is also reduced, as at 24, at a point opposite the split 23. This reduced portion 24 also extends throughout the vertical dimension of the inner ring and defines a hinge which permits the inner ring to flex between a closed position, as illustrated in FIG. 3, and an open position. In FIG. 2, the inner ring is illustrated in a partially opened position.

A pair of elongate, substantially straight ribs 25 are integrally formed with the inner ring 21 at the split 23 therein and project outwardly therefrom. Another pair of elongate, substantially straight ribs 26 are integral with the inner ring adjacent the reduced hinged portion 24 and project outwardly therefrom. These ribs are integral with a pair of arcuate sections 28, and it will be noted that each arcuate section extends between and is integral with one of the ribs 25 and one of the ribs 26. The arcuate sections 28 are also concentric with the inner ring 21. Each arcuate sector has a pair of intermediate arcuate ribs 27 integral therewith, and these ribs are also integral with the inner ring 21. It will be seen that each pair of arcuate ribs 27 defines a circular opening 29, and it will further be noted that each arcuate section has a slit 30 therein that communicates with the circular opening 29. It will also be noted that each arcuate section 28 is of diminished radial thickness adjacent the slot 30 to thereby define lips **30*a*. These lips 30*a* permit a rope or electrical conductor to be snapped into the opening 30** when the guard device is mounted on a drop pipe.

It will also be noted that each rib 25 cooperates with one of the ribs 27, the inner ring 21 and the arcuate section 28 to define a non-circular opening 31 therein. Similarly, each rib 26 cooperates with one of the arcuate ribs 27, the arcuate section 28 and the inner ring 21 to define another non-circular opening **31*a* therein adjacent the reduced hinged portion 24. Each arcuate section 28 has a pair of substantially flat, generally rectangular shaped tabs 32 integral therewith and projecting radially outwardly therefrom. The outer surface 33 of each tab 32 is adapted to engage the inner surface of the well casing 12 when the guard device 10** is applied to a drop pipe and the latter is positioned in a well casing.

Figure 4:
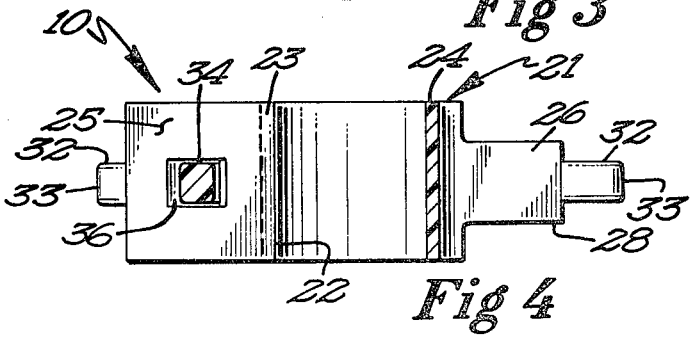
FIG. 4 is a cross-sectional view taken approximately along line 4—4 of FIG. 3 and looking in the direction of the arrows.

Referring now to FIG. 4, it will be seen that the inner ring 21 has a vertical dimension substantially greater than the vertical dimension of the arcuate sectors. It will also be noted that the self-engaging tabs 32 have a vertical dimension substantially less than the vertical dimension of the arcuate sections.

Means are also provided for releasably locking the guard device in a closed position, and this means includes an elongate arcuate locking element 34 which is integral with one of the ribs 25 and projects therefrom. The arcuate locking element is provided with locking teeth 35 on its inner surface. The other rib 25 has an opening 36 therein and an arcuate locking element 37 is integral with this rib 25 and projects therefrom. The outer surface of the arcuate locking element 37 has a plurality of teeth 38 formed thereon and these teeth are arranged to mate in interlocking relation with respect to the teeth 35 on the locking element 34. It will be seen that when the locking element 34 is urged through the opening 36, the teeth 35 will interlock with selected teeth on the arcuate locking element 37.

The exterior surface of the arcuate sections 28 adjacent the ribs 25 have recesses 39 therein, and these recesses accommodate a tool such as pliers to facilitate closing of the guard device upon a drop pipe. It will be noted that the locking element 34 has a vertical dimension corresponding generally to the vertical dimension of the tabs 32, and is substantially less than the vertical dimension of the inner ring 21. This locking element 34 may flex when the guard device is in the open position to permit a drop pipe to be moved past the locking element and into the inner ring 21. The interlocking teeth obviate the need of bolt assemblies for locking the guard device in the closed position.

In use, the guard device may be readily applied to the drop pipe section by flexing the guard device to an open position and pushing the pipe through the opening defined by the slit until the inner surface 22 of the inner ring engages the exterior surface of the pipe. Thereafter, the user may apply a tool, such as pliers or the like, to recesses 39 and thereby quickly urge the locking element 34 into locking engagement with the locking element 37. The guard device will then frictionally engage the pipe and will be locked thereon in its preselected position. Electrical wires, safety ropes, cables and the like may be snapped in and out of the circular openings 29 through the slits 30 because of the resilient snap action defined by the lips 30*a* adjacent the slit.

This application of the guard device distinguishes from the conventional prior art devices in that the drop pipe is not required to be strung endwise through the central opening in the guard device. This prior art manner of applying the guard device to the pipe is cumbersome by way of comparison to the guard device comprising the instant invention.

Thus it will be seen that I have provided a novel wire guard device for use with drop pipes, which is not only of simple and inexpensive construction, but one which functions in a more efficient manner than any heretofore comparable device.

While the preferred embodiments of the present invention have been described, it should be understood that various changes, adaptions and modifications may be made therein without departing from the spirit of the invention and the scope of the appended claims.

What is claimed is:

1. A single-piece guard device formed of a non-metallic material engagable with a well pipe for preventing the abrasion of the well pipe, electrical wires, ropes and the like with the well casing, comprising:

a circular inner ring having an inner surface and an outer surface and having a split therein to define an opening, the radial thickness of said inner ring being reduced at a location substantially opposite of said split to define a hinge thereat permitting flexing of the inner ring when in the open and closed positions, said inner ring when in the open position permitting a well pipe to pass through the opening defined at the split, and when in the closed position said inner ring engaging the well pipe;

a plurality of ribs integral with said inner ring and extending outwardly therefrom;

a pair of arcuate sections, each being integral with a plurality of said ribs and each section being disposed in substantially concentric, outwardly spaced relation with respect to said inner ring, adjacent pairs of said ribs cooperating with said inner ring and one of said arcuate sections to define an opening, each of said arcuate sections having a slit therein communicating with one of said openings and permitting an electrical conductor or rope or the like to be snapped through the slit when the device is mounted on a pipe, each of one adjacent pair of ribs extending outwardly from said inner ring at said split and being integral with adjacent end portions of said arcuate sections;

a plurality of tabs on each of said arcuate sections extending outwardly therefrom and being engagable with the well casing to space the associated pipe from the latter; and a pair of locking elements each being integral with one of said one adjacent pair of ribs and being urged into engaging locking relation with each other when said inner ring is in the closed position to mount the guard device on a pipe.

2. The invention as defined in claim 1 wherein said locking means comprises a pair of locking elements, each having a plurality of teeth thereon which interlock with each other when the device is in the closed position.

3. The invention as defined in claim 2 wherein one of said locking elements are of elongate arcuate configuration and are spaced inwardly of said arcuate sections and outwardly of said inner ring.

4. The invention as defined in claim 1 wherein said inner ring has a vertical dimension substantially greater than said arcuate sections, and said tabs having a vertical dimension substantially less than the vertical dimension of said arcuate sections.

5. The invention as defined in claim 1 wherein the vertical dimension of said locking elements is substantially less than the vertical dimension of said inner ring to thereby permit at least one of said locking elements to flex during passage of the drop pipe through the opening defined by said slit.

6. The invention as defined in claim 1 wherein each of another pair of adjacent ribs extends outwardly from adjacent said hinge of the inner ring and being integral with adjacent end portions of arcuate sections.

7. The invention as defined in claim 1 wherein said slit in each arcuate section is spaced circumferentially and located between a pair of said tabs on the associated arcuate section.

* * * * *